US011261014B2

(12) United States Patent
Zacherle

(10) Patent No.: US 11,261,014 B2
(45) Date of Patent: Mar. 1, 2022

(54) CARRIER AND BLANK THEREFOR

(71) Applicant: WestRock Packaging Systems, LLC, Atlanta, GA (US)

(72) Inventor: Matthew E. Zacherle, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 0 days.

(21) Appl. No.: 17/055,770

(22) PCT Filed: May 15, 2019

(86) PCT No.: PCT/US2019/032407

§ 371 (c)(1),
(2) Date: Nov. 16, 2020

(87) PCT Pub. No.: WO2019/222341

PCT Pub. Date: Nov. 21, 2019

(65) Prior Publication Data

US 2021/0229886 A1 Jul. 29, 2021

Related U.S. Application Data

(60) Provisional application No. 62/672,170, filed on May 16, 2018.

(51) Int. Cl.
*B65D 71/50* (2006.01)
*B65D 71/42* (2006.01)

(52) U.S. Cl.
CPC ..... *B65D 71/504* (2013.01); *B65D 71/42* (2013.01)

(58) Field of Classification Search
CPC ..... B65D 71/42; B65D 71/44; B65D 71/46; B65D 71/50; B65D 71/504; B65D 2301/10

(Continued)

(56) References Cited

U.S. PATENT DOCUMENTS 3,302,364 A 2/1967 Rice
4,518,081 A * 5/1985 de Larosiere ..... B65D 71/50 206/158

(Continued)

FOREIGN PATENT DOCUMENTS

WO 93/21083 A1 10/1993
WO 2017/192472 A1 11/2017
WO WO-2017192472 A1 * 11/2017 ..... B65D 71/504

OTHER PUBLICATIONS

International Search Report issued in PCT/US2019/032407, dated Aug. 9, 2019.

*Primary Examiner* — Bryon P Gehman
(74) *Attorney, Agent, or Firm* — Brian J. Goldberg

(57) ABSTRACT

Aspects of the disclosure relate to a carrier for packaging one or more articles. The carrier is formed from a set of connected blanks each of which form a top engaging carrier, wherein the blanks are detachably connected together in a matrix fashion wherein each blank has a plurality of top-receiving apertures wherein a first distance ($D_1$) between the respective centres of two adjacent ones of the apertures of a first blank is less than a second distance ($D_2$) between the centre of a corner aperture of the first blank and the centre of the adjacent corner aperture of a second blank and wherein the first distance ($D_1$) is less than a third distance ($D_3$) between the centre of the corner aperture of the first blank and the centre of the adjacent corner aperture of a third blank.

15 Claims, 4 Drawing Sheets

(58) Field of Classification Search
USPC ..... 206/150–152, 158
See application file for complete search history.

(56) References Cited

U.S. PATENT DOCUMENTS

| | | | | |
|---|---|---|---|---|
| 10,836,550 | B2 * | 11/2020 | Zacherle | B65D 71/50 |
| 2018/0222650 | A1 * | 8/2018 | Zacherle | B65D 71/50 |
| 2019/0135512 | A1 * | 5/2019 | Kooc | B65D 71/42 |
| 2020/0010255 | A1 * | 1/2020 | Zacherle | B65D 71/42 |

* cited by examiner

CARRIER AND BLANK THEREFOR

This Application is a U.S. 371 National Phase of International PCT Patent Application No. PCT/US2019/032407, filed May 15, 2019, which application claims the benefit of U.S. Provisional Application 62/672,170 filed May 16, 2018. The entire contents of these applications are incorporated herein by reference in their entirety.

TECHNICAL FIELD

The present invention relates to cartons and to blanks for forming the same. More specifically, but not exclusively, the invention relates to a plurality of connected blanks for forming carriers of the top-gripping type having one or more apertures for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said aperture. The tabs are displaced out of the plane of said panel when an article is received in the aperture, wherein said tabs engage the article generally about a flange or lip of the article.

It is desirable to simplify construction of the blank into a carrier, it is an object of the present disclosure to enable a plurality of connected blanks to be simultaneously assembled into packages. The carrier should be sufficiently robust to withstand the load of the articles. It desirable that the carriers should be capable of packaging generally cylindrical articles, such as but not limited to beverage cans, which articles are of a sleek or slim design.

The present invention seeks to provide an improvement in the field of cartons, typically formed from paperboard or the like.

SUMMARY

A first aspect of the invention provides a set of connected blanks each for forming a top engaging carrier, wherein the blanks are detachably connected together in a matrix fashion wherein each blank has a plurality of top-receiving apertures wherein a first distance $D_1$ between the respective centres of two adjacent ones of the apertures of a first blank is less than a second distance $D_2$ between the centre of a corner aperture of the first blank and a centre of an adjacent corner aperture of a second blank and wherein the first distance $D_1$ is less than a third distance $D_3$ between the centre of the corner aperture of the first blank and a centre of an adjacent corner aperture of a third blank.

Optionally, the first distance $D_1$ is generally equal to the maximum diameter $D_c$ of a generally cylindrical article adapted to be engaged by the first blank.

Optionally, a corner radius $R_b$ of each blank is greater than a half of the maximum diameter Dc of a generally cylindrical article adapted to be engaged by that blank.

Optionally, the corner radius $R_b$ is at least ⅛ inch (3.175 mm) greater than a half of the maximum diameter $D_c$ of a generally cylindrical article adapted to be engaged by that blank.

Optionally, the second distance $D_2$ is generally equal to the third distance $D_3$.

Optionally, each of the second and third distances $D_2$, $D_3$ is generally equal to twice a corner radius $R_b$ of each blank.

Optionally, a fourth distance $R_s$ is defined between the outer end of each tab-defining element and the centre of the respective aperture, the fourth distance $R_s$ is equal to or less than a half of the maximum diameter $D_c$ of a generally cylindrical article adapted to be engaged by that blank.

Optionally, any point on the outline of a finger aperture is disposed outside an area defined by a radius equal to half of the maximum diameter (½ $D_c$) around the centre of any one of the apertures which surround the finger aperture.

A second aspect of the invention provides a blank for forming a top engaging carrier, the blank comprising a plurality of apertures each for receiving a portion of a generally cylindrical article wherein a first distance $D_1$ between the centres of two adjacent ones of the apertures is generally equal to the maximum diameter $D_c$ of the article and a corner radius $R_b$ of the blank is greater than a half of the maximum diameter $D_c$ of the article.

Optionally, the corner radius $R_b$ is at least ⅛ inch (3.175 mm) greater than a half of the maximum diameter $D_c$ of the article.

Optionally, a fourth distance $R_s$ is defined between the outer end of each tab-defining element and the centre of the respective aperture, the fourth distance $R_s$ is equal to or less than a half of the maximum diameter $D_c$ of a generally cylindrical article adapted to be engaged by that blank.

Optionally, the maximum diameter $D_a$ of each aperture is less than the upper end diameter $D_n$ of the article.

Optionally, any point on the outline of a finger aperture is disposed outside an area defined by a radius equal to half of the maximum diameter (½ $D_c$) around the centre of any one of the apertures which surround the finger aperture.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
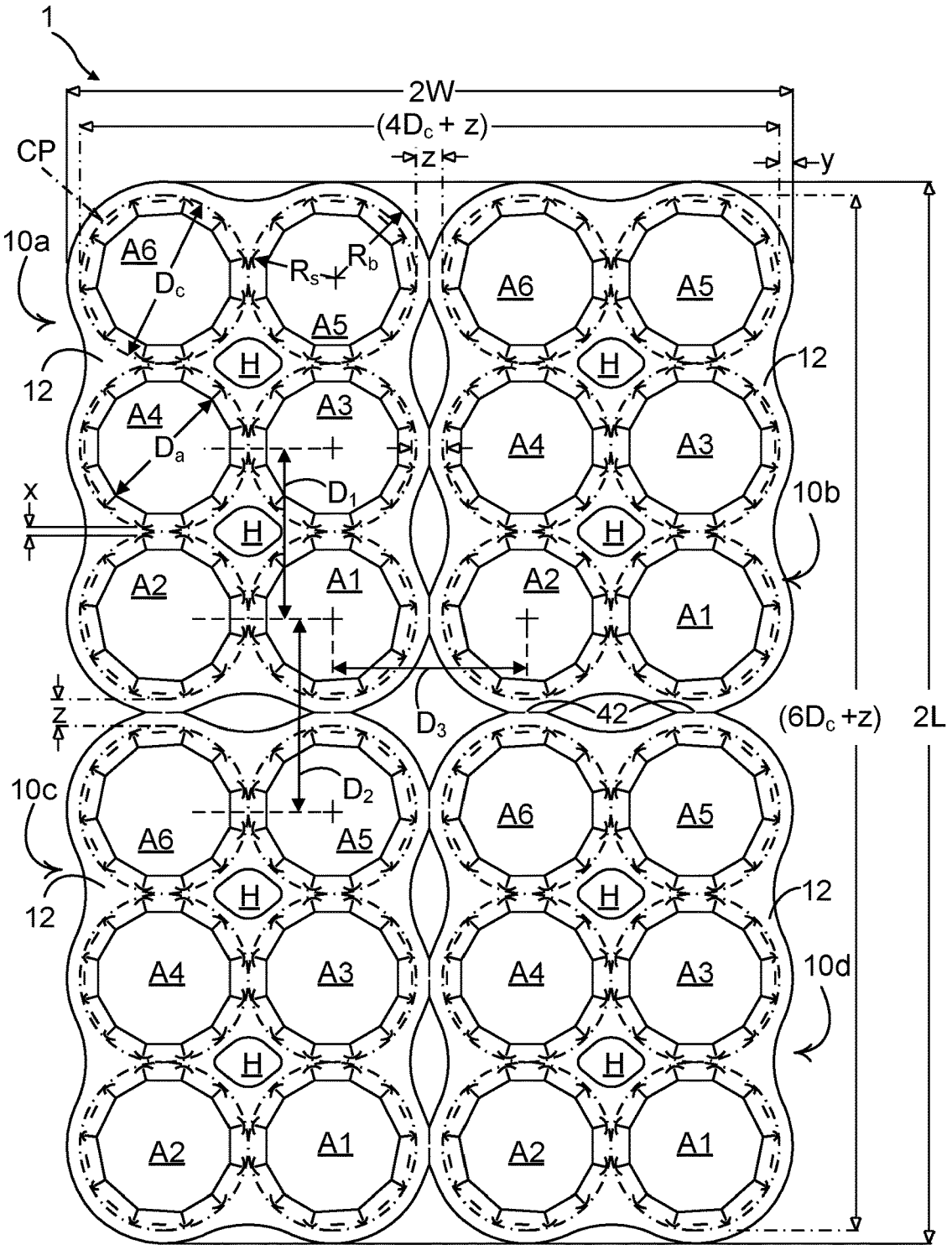
FIG. 1 is a plan view from above of a plurality of connected blanks, each blank for forming a carrier according to a first embodiment.
Figure 2:
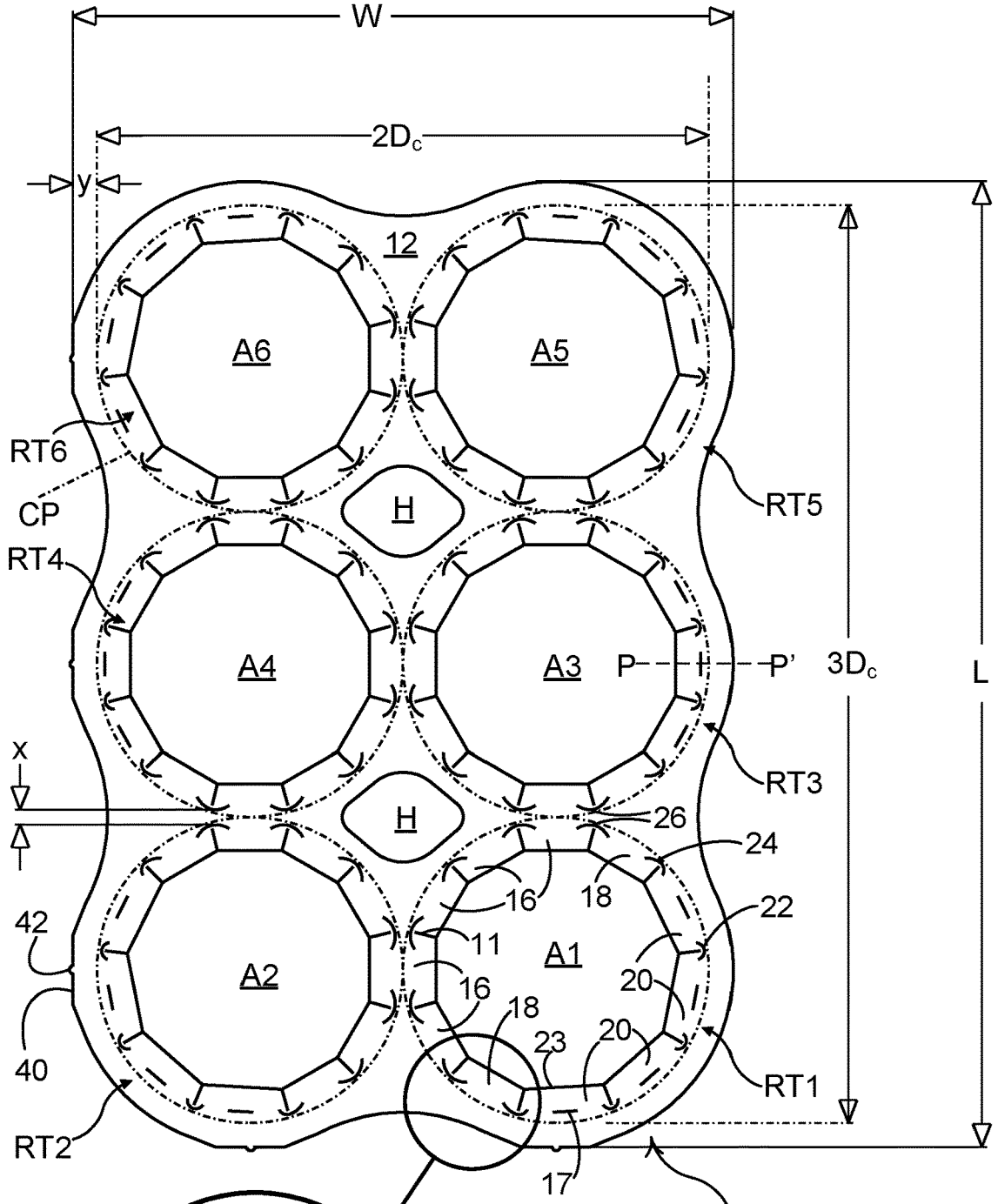
FIG. 2 is a plan view from above of one the blanks of FIG. 1.
Figure 3:
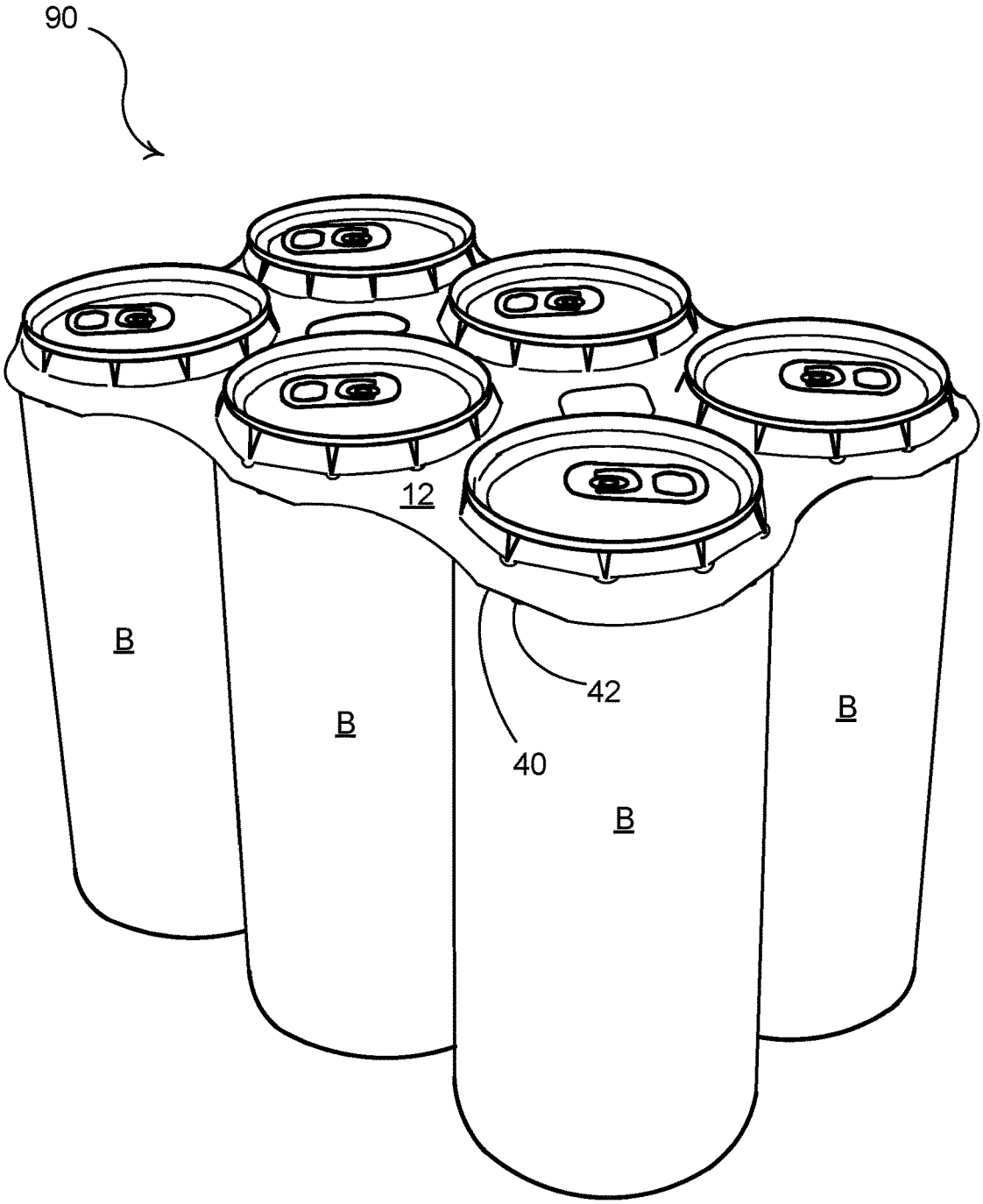
FIG. 3 is a perspective view of a carton formed from the blank of FIG. 2.

Referring to FIG. 1, there is shown a plan view of a plurality of connected blanks 10*a*, 10*b*, 10*c*, 10*d* capable of forming a carton or carrier 90, as shown in FIG. 3, for containing and carrying a group of primary products such as, but not limited to, bottles or cans, hereinafter referred to as articles B, as shown in FIG. 2. The blanks 10*a*, 10*b*, 10*c*, 10*d* form a secondary package for packaging at least one primary product container or package.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10*a*, 10*b*, 10*c*, 10*d* are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

Figure 4:
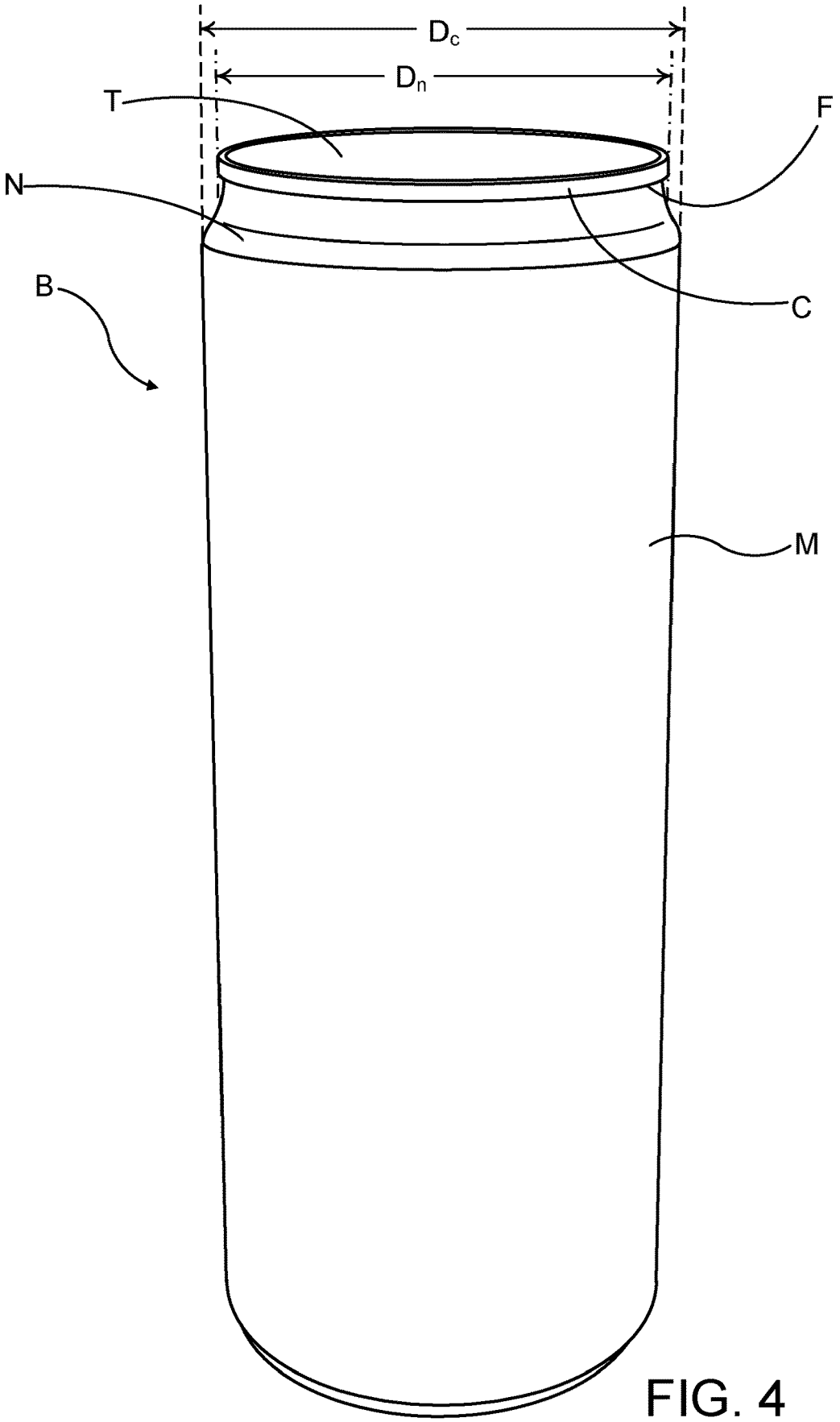
FIG. 4 is a perspective view of a primary product container for use with the carrier of the first embodiment.

In the illustrated embodiments, the blanks 10*a*, 10*b*, 10*c*, 10*d* are configured to form a carton or carrier 90 for packaging an exemplary arrangement of exemplary articles B. In the embodiment illustrated, each blank 10*a*, 10*b*, 10*c*, 10*d* forms a package having an arrangement in the form of a 2×3 matrix or array; in the illustrated embodiment two rows of three articles are provided, and the articles B are beverage cans. The beverage cans may be 12 oz (355 ml) cans of the sleek or slim design; that is to say the articles B are substantially of the same diameter over their entire height. An exemplary article B is illustrated in FIG. 4, the article B has a maximum diameter or lateral dimension $D_c$ (the diameter $D_c$ may be about 2.25 inches or about 58 mm). The article B comprises an upper portion or top closure T which has a diameter or lateral dimension $D_n$ (the diameter $D_n$ may be about 2.125 inches or 54.8 mm). The neck N may provide an outwardly projecting flange, that is to say it may comprise an undercut for engaging with the carrier. A top closure may be attached to the side wall of the article B to form a seam or "chime" C which provides the flange F. In embodiments of the inventions the variation in diameter between the top closure T and the main body M of the article B is less than 7 mm, may be less than 5 mm and optionally is less than 4 mm.

As used herein the terms "sleek" or "slim" refer to article which have little or no variation in their lateral dimension between the top closure T which engages with the carrier 90 and the main body M of the article B. The articles are substantially parallel sided or of substantially uniform diameter.

Referring to FIG. 1, there is shown a plurality of blanks 10*a*, 10*b*, 10*c*, 10*d*, in the illustrated embodiment there are four blanks 10*a*, 10*b*, 10*c*, 10*d* arranged in a 2×2 matrix or array. Each blank 10*a*, 10*b*, 10*c*, 10*d* is connected to at least two adjacently disposed blanks 10*a*, 10*b*, 10*c*, 10*d* by a frangible or severable connection 42. Each blank 10*a*, 10*b*, 10*c*, 10*d* comprises a main panel 12 for forming a top wall or engaging panel of a carrier 90 (see FIG. 3).

Each of the main panels 12 includes at least one article retention structure RT1, RT2, RT3, RT4, RT5, RT6. In the embodiment of FIG. 1 each main panel 12 comprises a plurality of article retention structures RT1, RT2, RT3, RT4, RT5, RT6, specifically six article retention structures RT1, RT2, RT3, RT4, RT5, RT6 arranged in a 2×3 matrix or array. In other embodiments, alternative arrangements may be employed, for example but not limited to four article retention structures RT1, RT2, RT3, RT4 arranged in a 2×2 matrix or array; in such embodiments the plurality of blanks 10*a*, 10*b*, 10*c*, 10*d* may include six blanks severably connected to form a 2×3 matrix or array. Another alternative arrangement may be three article retention structures RT1, RT3, RT5 arranged in a 1×3 configuration; in such an embodiments the plurality of blanks 10*a*, 10*b*, 10*c*, 10*d* may include eight blanks severably connected to form a 2×4 matrix or array. Another alternative arrangement may be two article retention structures RT1, RT3; or RT1, RT2 arranged in a 1×2 configuration; in such an embodiments the plurality of blanks 10*a*, 10*b*, 10*c*, 10*d* may include twelve blanks severably connected to form a 2×6 or 3×4 matrix or array. Still another alternative arrangement may be four article retention structures RT1, RT2, RT1, RT2 arranged in a 1×4 configuration; in such an embodiments the plurality of blanks 10*a*, 10*b*, 10*c*, 10*d* may include six blanks severably connected to form a 1×6 configuration. Still further alternative arrangement may be eight article retention structures RT1, RT2, RT3, RT4, RT5, RT6, RT1, RT2 arranged in a 2×4 configuration; in such an embodiments the plurality of blanks 10*a*, 10*b*, 10*c*, 10*d* may include three blanks severably connected to form a 1×3 configuration.

Figure 2A:
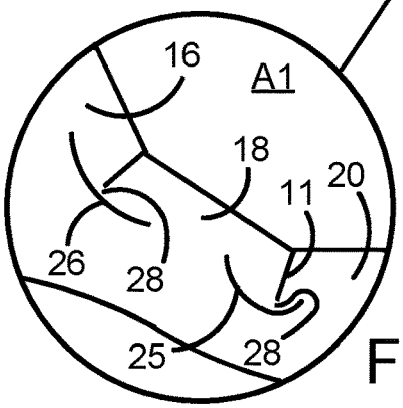
FIG. 2A is an enlarged view of a portion of the blank of FIG. 2.

Each of the article retention structures RT1, RT2, RT3, RT4, RT5, RT6 is substantially similar in construction and will therefore be described in detail with reference to a first article retention structure RT1 as illustrated in FIGS. 2 and 2A. FIG. 2 shows a single blank 10 which has been separated from the plurality of blanks 10*a*, 10*b*, 10*c*, 10*d*. FIG. 2*a* shows an enlarged portion of the blank 10.

The first article retention structure RT1 comprises an aperture A1. The first aperture A1 is an eleven-sided polygon or hendecagon. In other embodiments, other polygonal shapes may be employed.

A plurality of article engaging tabs 16, 18, 20 are arranged about the periphery of the aperture A1. Each tab 16, 18, 20 is hinged to the main panel 12.

Each tab 16, 18, 20 is separated from its adjacent neighbours by a linear cutline 11. In this way each tab 16, 18, 20 comprises a first side edge 19 and a second side edge 21. Each tab 16, 18, 20 comprises a free end edge 23 opposing a hinged edge. The free end edges 23 form engaging edges for retaining an article B, or at least a portion thereof, within the aperture A1.

The free end edges 23 each defines a side of the polygonal shape of the first aperture A1. Each of the linear cutlines 11, which define the side edges of the tabs 16, 18, 20, extend from a vertex or corner of the polygonal shape of the first aperture A1. The linear cutlines 11 may be substantially radially arranged with respect to a notional circle that passes through each of the vertices of the polygonal shape of the first aperture A1. The linear cutlines 11 comprise a first proximal end that intersects with a vertex or corner of the polygonal shape of the first aperture A1. The linear cutlines 11 comprise a second distal end.

The plurality of article engaging tabs 16, 18, 20 comprises a series or set of first article engaging tabs 16, a series or set of second article engaging tabs 18, and a series or set of third article engaging tabs 20.

The set of first article engaging tabs 16 are located on the main panel 12 in a region in which the article engaging tabs are subject to the greatest stress or deformation when an article B is received in the first article retention structure RT1.

A first arcuate cutline 26 is disposed proximate each of the linear cut lines 11 defining the side edges of the first article engaging tabs 16. Each first arcuate cutline 26 is spaced apart from the second distal end of the linear cutlines 11 so as to define a connecting portion 28 or "nick" between a pair of adjacent first article engaging tabs 16.

The set of third article engaging tabs 20 are located on the main panel 12 in a region in which the article engaging tabs are subject to the least stress or deformation when an article B is received in the first article retention structure RT1.

A third arcuate cutline 22 is disposed proximate each of the linear cut lines 11 defining the side edges of the third article engaging tabs 20. Each third arcuate cutline 22 is spaced apart from the second distal end of the linear cutlines 11 so as to define a connecting portion 28 or "nick" between a pair of adjacent third article engaging tabs 20. Those connecting portions 28 or "nicks" are provided for maintaining a connection between a pair of adjacent tabs 16, 18, 20 even after an article B is inserted into the aperture A1, A2, A3, A4, A5, A6. The connecting portions 28 connect the respective tab 16, 18, 20 with the next adjacent tab 16, 18, 20, thereby preventing or inhibiting the respective tab 16, 18, 20 from wobbling or rotating about the axis denoted by notional line P-P' or at least mitigating against such wobbling or rotation.

The set of second article engaging tabs 18 are located on the main panel 12 so as to provide a transition between one of the first article engaging tabs 16 and one of the third article engaging tabs 20.

A second arcuate cutline 24, 25 is disposed proximate a cut line 11 separating each of the second article engaging tabs 18 from an adjacent third article engaging tab 20.

Each second arcuate cutline 24, 25 is spaced apart from the second distal end of the linear cutlines 11 so as to define a connecting portion 28 or "nick" between a respective one of the second article engaging tabs 18 and the third article engaging tab 20 adjacent to it.

Each of the first and third arcuate cutlines 22, 26 is arranged symmetrically about the linear cutline with which it is associated. Each of the second arcuate cutlines 24, 25 is asymmetrically arranged about one of the linear cutlines 11.

The first, second and third arcuate cutlines 26, 24, 25, 22 provide stress relief in the main panel 12 when the first, second and third article engaging tabs 16, 18, 20 are displaced out of the plane of the main panel 12.

The first and third arcuate cutlines 26, 22 are arranged symmetrically about the respective linear cutline 11 with which they are associated. The first arcuate cutlines 26 are larger in dimension than the third arcuate cutlines 22. The first arcuate cutlines 26 comprise a first radius of curvature, the third arcuate cutlines 22 comprise a second radius of curvature; the first radius of curvature is larger than the second radius of curvature.

Each of the second cutlines 24, 25 is arranged asymmetrically about the respective linear cutline 11 with which it is associated. The second cutlines 24, 25 comprise a first portion and a second portion contiguously arranged with each other. The first portion is disposed proximate the second article engaging tab 18 and the second portion is disposed proximate a third article engaging tab 20. The first portion of each of the second cutlines 24, 25 comprises a first radius of curvature, the second portion of each of the second cutlines 24, 25 comprises a second radius of curvature; the first radius of curvature is larger than the second radius of curvature.

The second cutlines 24, 25 may be considered to comprise one half of a first arcuate cutline 26 and one half of a third arcuate cutline 22 contiguously arranged with each other.

The second cutlines 24, 25 form asymmetrical 'C'-shaped cuts, whereas the first and third cutlines 26, 22 form symmetrical 'C'-shaped cuts. The second cutlines 24, 25 are employed at the boundary between a first area of the main panel 12 that is subject to higher stress upon displacement of the first article engaging tabs 16 and a second area of the main panel 12 that is subject to lower stress upon displacement of the third article engaging tabs 20. The higher stress area of the main panel 12 occurs where the first tabs 16 are located as these first tabs 16 undergo higher bending stress, when an article B is inserted into the respective aperture A1, A2, A3, A4, A5, A6 than the third tabs 20 disposed in the lower stress area of the main panel 12.

Each of the third article engaging tabs 20 is defined in part by a second linear cutline 17 provided in the main panel 12.

Each second linear cutline 17 is disposed between a pair of adjacent arcuate cutlines 26, 24, 25, 22 in a spaced apart relationship with each of the pair of adjacent arcuate cutlines 26, 24, 25, 22. Each of the third article engaging tabs 20 adjacent to one of the second article engaging tabs 18 comprises a second linear cutline 17 disposed between a first arcuate cutline 26 and second arcuate cutlines 24, 25 in a spaced apart relationship with respect to both the first arcuate cutline 26 and the second arcuate cutlines 24, 25. The remaining third article engaging tabs 20 comprise a second linear cutline 17 disposed between a pair of adjacent first arcuate cutlines 26 in a spaced apart relationship with each of the pair of adjacent first arcuate cutlines 26.

The second linear cutline 17 facilitates folding of each of the third article engaging tabs 20 with respect to the main panel 12.

The second linear cutline 17 defines at least in part a straight or linear fold line 17 by which each of the third article engaging tabs 20 is hinged to the main panel 12.

In the illustrated embodiment the first article retention structure RT1 comprises eleven tabs 16, 18, 20 arranged about the periphery of the aperture A1.

Optionally, the plurality of article engaging tabs 16, 18, 20 may vary in dimension according to their location on the main panel 12. The first article engaging tabs 16 may have a first width, the second article engaging tabs 18 may have a second width and the third article engaging tabs 20 may have a third width. The third width may be greater than the second width which in turn may be greater than the first width. In this way the free end edge 23, which forms an engaging edge E1, E2, of the first tabs 16 is smaller in dimension than the free end edge 23 or engaging edge of the second or third tabs 18, 20.

In the illustrated embodiment, the article engaging tabs 16, 18, 20 located in the region of the main panel 12 and subject to the greatest stress or deformation when an article B is received in the article retention structure RT1, RT2, RT3, RT4, RT5, RT6 are smaller in dimension than the article engaging tabs 16, 18, 20 located in the region of the main panel 12 subject to the least stress or deformation.

The main panel 12 may optionally comprise a handle structure. The handle structure may comprise a pair of handle apertures H. Each of the pair of handle apertures H is struck from the main panel 12. One of the pair of handle apertures H is located in a region disposed centrally between a first pair of article retention structures RT1, RT2 and a second pair of article retention structures RT3, RT4. Said one of the pair of handle apertures H comprises a periphery which periphery is spaced from the centres of each of the apertures A1, A2, A3, A4 by a distance equal to or greater than the maximum diameter $D_c$ of the articles B. The other one of the pair of handle apertures H is located in a region disposed centrally between the and a second pair of article retention structures RT3, RT4 and a third pair of article retention structures RT5, RT6. Said other one of the pair of handle apertures H comprises a periphery which periphery is spaced from the centres of each of the apertures A3, A4, A5, A6 by a distance equal to or greater than the maximum diameter $D_c$ of the articles B.

Optionally, the side and/or end edges of the main panel 12 may be arranged in a curvilinear or undulating shape.

The corners of the main panel 12 are rounded, the corners define an arc having a radius of curvature $R_b$. The arc may be centred on the centre of the aperture A1, A2, A5, A6 of the endmost article retention structures RT1, RT2, RT5, RT6.

The main panel 12 includes at least a paperboard substrate and a tear resistant layer laminated together. It optionally includes an adhesive layer between the paperboard substrate and the tear resistant layer. The material of the paperboard substrate may be selected from any conventional paperboard, for example, ranging in weight upwardly from about 10 pt., preferably from about 11 pt. to about 14 pt. An example of such a substrate is a 12-point SBS board or CNK board manufactured by WestRock Company. The paperboard substrate may be a bleached or unbleached board. The board may be coated on at least one side, optionally the side opposite the lamination, with a conventional coating selected for compatibility with the printing method and board composition.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

The positions of the articles B with respect to the blanks 10*a*, 10*b*, 10*c*, 10*d* are indicated by notional lines CP. The notional lines CP indicate the position of the cylindrical wall of the main body of an article B shown in FIG. 4 with respect to the blanks 10*a*, 10*b*, 10*c*, 10*d*. In the embodiment of FIG. 1 the position of twenty-four articles B with respect to the plurality of blanks 10*a*, 10*b*, 10*c*, 10*d* is indicated. The articles B are disposed in four distinct groups of six articles.

Each article B is aligned with one of the apertures A1, A2, A3, A4, A5, A6 of the article retention structure RT1, RT2, RT3, RT4, RT5, RT6 of one of the blanks 10*a*, 10*b*, 10*c*, 10*d*. The tubular axis of the articles B is in registry with the centre of one of the apertures A1, A2, A3, A4, A5, A6.

Each article B with an article group is disposed in touching contact, or in at least close proximity, with at least two adjacent neighbours. The articles B in one group are spaced apart from the nearest adjacent articles B in the neighbouring group by a distance z. This enables each of the adjacently disposed blanks 10*a*, 10*b*, 10*c*, 10*d* to provide a sufficiently thick portion of the main panel 12 about the articles B when the plurality of blanks 10*a*, 10*b*, 10*c*, 10*d* are applied simultaneously to all of the article groups. The spacing apart of the article groups by the distance z is particularly important when packaging articles of the "sleek" or "slim" design as shown in FIG. 4 where there is little or no difference in diameter between the top end closure and/or neck with respect to the side wall of the main body M of the article B.

Each blank 10*a*, 10*b*, 10*c*, 10*d* comprises a maximum width W, as shown in FIG. 2. The main panel 12 is arranged to be wider than the width of the group of articles B which it accommodates, the edge of the main panel 12 is spaced a distance y from the position of the cylindrical side wall CP of the article B, where y=(½ z).

The plurality of blanks 10*a*, 10*b*, 10*c*, 10*d* comprises a maximum width 2W.

Each blank 10*a*, 10*b*, 10*c*, 10*d* comprises a maximum length L, as shown in FIG. 2. The main panel 12 is arranged to be longer than the length of the group of articles B which it accommodates, the edge of the main panel 12 is spaced a distance y from the position of the cylindrical side wall CP of the article B, where y=(½ z).

The plurality of blanks 10*a*, 10*b*, 10*c*, 10*d* comprises a maximum length 2L.

In this way the outer perimeter of the main panel 12, in the flat blank form, is spaced a distance equal to or greater than distance y from the group of articles B as shown in FIG. 2.

The main panel 12 therefore comprises a boundary region surrounding the article group.

The apertures A1, A2, A3, A4, A5, A6 have a maximum lateral dimension or diameter of $D_a$.

The centre of any one of the first, second, third, fourth, fifth and sixth apertures A1, A2, A3, A4, A5, A6 of a given blank 10*a*, 10*b*, 10*c*, 10*d* is spaced from the centre of an adjacent one of the apertures A1, A2, A3, A4, A5, A6 of said blank 10*a*, 10*b*, 10*c*, 10*d* by a dimension $D_1$, dimension $D_1$ may be substantially equal to $D_c$, ($D_1=D_c$). The cylindrical axes of the articles B of a given article group may be similarly spaced apart.

The centre of a first aperture A1 of a first blank 10*a* is spaced from the centre of an adjacent aperture A2, of a second blank 10*b*, by a dimension $D_3$, dimension $D_3$ may be substantially equal to the sum of dimension $D_c$ and dimension z; ($D_3=D_c+z$). The cylindrical axes of the respective articles B may be similarly spaced apart.

The centre of a first aperture A1 of a first blank 10*a* is spaced from the centre of an adjacent aperture A5, of a third blank 10*c*, by a dimension $D_2$, dimension $D_2$, dimension $D_2$ may be substantially equal to the sum of dimension $D_c$ and dimension z; ($D_2=D_c+z$). The cylindrical axes of the respective articles B may be similarly spaced apart.

The cutlines 26 of the first retention structure RT1 are arranged to be spaced at least a distance x from the cutlines 26 of the third retention structure RT1. The cutlines 26 of each retention structure RT1, RT2, RT3, RT4, RT5, RT6 are arranged to be spaced at least a distance x from the cutlines 26 of the an adjacent, retention structure RT1, RT2, RT3, RT4, RT5, RT6.

The distance between the centre of one of the apertures A1, A2, A3, A4, A5, A6 and the outer end of each one of the tabs 16, 18, 20 surrounding the said aperture A1, A2, A3, A4, A5, A6 is given by dimension $R_s$. The outer end of each one of the tabs 16, 18, 20 may be defined by the distal end of the radial cutlines 11. The distance $R_s$ is less than or equal to half the maximum diameter $D_c$ of the articles B, ($R_s \leq ½ D_c$). The distance $R_s$ is greater than half the maximum diameter $D_a$ of the apertures A1, A2, A3, A4, A5, A6, ($R_a > ½ D_a$).

The article retention structure RT1, RT2, RT3, RT4, RT5, RT6 each define an opening which is formed in part from a respective one of the apertures A1, A2, A3, A4, A5, A6 and from the plurality of article engaging tabs 16, 18, 20 associated with each aperture A1, A2, A3, A4, A5, A6. The opening comprise a diameter or maximum lateral dimension which may be less than the maximum diameter $D_c$ of the article B to be received therein.

Referring again to FIG. 1 each of the corners of the blanks 10*a*, 10*b*, 10*c*, 10*d* may be rounded in shape. The rounded corners may be defined by a corner radius $R_b$. The corner radius $R_b$ is greater than half the maximum diameter $D_c$ of the articles B ($R_b > ½ D_c$). In some embodiments, the corner radius $R_b$ is ⅛ inches (3.175 mm) larger than half the maximum diameter $D_c$ of the articles B, in other embodiments the corner radius $R_b$ is more than ⅛ inches (3.175 mm) larger than half the maximum diameter $D_c$ of the articles B.

The dimensions $D_2$, $D_3$ may be generally equal to twice the corner radius $R_b$, ($D_2=D_3 \approx 2R_b$).

The dimensions $D_2$, $D_3$ are greater than the dimension $D_1$, ($D_1<D_2$; $D_1<D_3$).

Each of the handle apertures H are arranged to be in registry with a void between four adjacently disposed articles B. Each of the handle apertures H comprises an outline defining an edge of the main panel 12.

Each of the plurality of blanks 10*a*, 10*b*, 10*c*, 10*d* is severably connected to adjacently disposed ones of the plurality of blanks 10*a*, 10*b*, 10*c*, 10*d* by a connecting bridge portion or connecting nick 42. The adjacently disposed blanks may be in touching contact over a short linear section 40, see FIG. 2, of the outer edge of the blanks 10*a*, 10*b*, 10*c*, 10*d*.

Turning to the construction of the carrier 90 from the blank 10, the plurality of blanks 10*a*, 10*b*, 10*c*, 10*d* may be applied to a plurality of groups of articles B. The plurality of blanks 10*a*, 10*b*, 10*c*, 10*d* is lowered with respect to the groups of articles B. Each of the article retention structures RT1, RT2, RT3, RT4, RT5, RT6 of each of the plurality of blanks 10*a*, 10*b*, 10*c*, 10*d* is aligned with a respective article B in one of the groups of articles B. Portions of the articles B pass through the main panels 12. The tabs 16, 18, 20 of each of the article retention structures RT1, RT2, RT3, RT4, RT5, RT6 are folded out of the plane of the main panels 12 and engage beneath the chime C (which may provide a flange F, see FIG. 4,) of an article B. In this way, the tabs 16, 18, 20 grip or hold the article B and prevent or inhibit the articles B from unintentionally separating from the main panels 12. The assembled carrier 90 is shown in FIG. 3.

Referring in particular to FIG. 3, each of the blanks 10*a*, 10*b*, 10*c*, 10*d* form a top engaging carrier 90, only one of which is shown, comprising a main panel 12 which comprises apertures A1, A2, A3, A4, A5, A6 each receiving a portion of a respective article B. The main panel 12 further comprises an annular series of tabs 16, 18, 20 formed around each of the first and second apertures A1, A2, A3, A4, A5, A6. The tabs 16, 18, 20 of each annular series are connected to the main panel 12 such that the tabs 16, 18, 20 yield out of the plane of the main panel 12, about fold lines 31, when an article B is received in the respective aperture A1, A2, A3, A4, A5, A6 so as to bear against the article B.

Another optional feature of the carrier 90 is that the main panel 12 is defined by a perimeter to which no other part of the carrier 90 is connected, once each of the blanks 10*a*, 10*b*, 10*c*, 10*d* are separated from the plurality of blanks 10*a*, 10*b*, 10*c*, 10*d*. That is to say, the carrier 90 is free of connection to other panels for example, but not limited to, side or end wall panels which extend about the sides of the article group. The perimeter of the main panel 12 is therefore defined in its entirety by free, cut or unhinged edges.

Another optional feature of the carrier 90 is that the main panel 12 is defined by a perimeter including convexly curved edges and concavely curved edges, wherein the radius of curvature of the convexly curved edges is substantially equal to the radius of curvature of the concavely curved edges.

The present disclosure provides a carrier of the top engaging type having improved article retention structures. In particular, the retention structures comprise article engaging tabs which yield upon insertion of an article. The tabs engage with an article to hold or secure the article within a panel of the carrier. The construction of the tabs is dependent upon the location of the tabs within the panel of the carrier. Those tabs subject to the greatest stress, typically those disposed in the interior regions of the panel or in close proximity to a tab of an adjacent retention structure, are provided with a stress relieving mechanism in the form of cutlines. The cutlines are provided proximate the side edge of the tabs and interrupt or define a fold line between the tab and the panel from which it is struck or formed.

The dimension of a tab may also be dependent upon its location in the panel of the carrier. Those tabs disposed in higher stress areas may be smaller in width than tabs subject to lesser stress.

The carrier is formed from a blank which is adapted to be applied to a group of articles simultaneously with at least one further blank which is similarly arranged. The blank and further blanks being severably from each other upon application to their respective groups of articles. The blank comprises a projecting edge forming a border or brim which surrounds the group of articles which is accommodates.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A set of connected blanks each for forming a top engaging carrier, wherein the blanks are detachably connected together in a matrix fashion wherein each blank has a plurality of top-receiving apertures wherein a first distance ($D_1$) between the respective centres of two adjacent ones of the apertures of a first blank is less than a second distance ($D_2$) between a centre of a corner aperture of the first blank and a centre of an adjacent corner aperture of a second blank and wherein the first distance ($D_1$) is less than a third distance ($D_3$) between the centre of the corner aperture of the first blank and a centre of an adjacent corner aperture of a third blank.

2. The set of claim 1 wherein the first distance ($D_1$) is generally equal to the maximum diameter ($D_c$) of a generally cylindrical article adapted to be engaged by the first blank.

3. The set of claim 1 wherein a corner radius ($R_b$) of each blank is greater than a half of the maximum diameter ($D_c$) of a generally cylindrical article adapted to be engaged by that blank.

4. The set of claim 3 wherein the corner radius ($R_b$) is at least ⅛ inch (3.175 mm) greater than a half of the maximum diameter ($D_c$) of a generally cylindrical article adapted to be engaged by that blank.

5. The set of claim 1, wherein the second distance ($D_2$) is generally equal to the third distance ($D_3$).

6. The set of claim 5 wherein each of the second and third distances ($D_2$, $D_3$) is generally equal to twice a corner radius ($R_b$) of each blank.

7. The set of claim 1 wherein a fourth distance ($R_s$) is defined between an outer end of a tab-defining element and a center of a respective aperture about which the tab-defining element is disposed, the fourth distance ($R_s$) is equal to or less than a half of the maximum diameter ($D_c$) of a generally cylindrical article adapted to be engaged by that blank.

8. The set of claim 1 wherein any point on the outline of a finger aperture formed in each blank is disposed outside an area defined by a radius equal to half of the maximum diameter (½ Dc) around the center of any one of the apertures which surround the finger aperture.

9. The set of claim 1, wherein the second blank is detachably connected to the first blank along a first edge thereof, and wherein the third blank is detachably connected to the first blank along a second edge, the second edge being adjacent to the first edge.

10. The set of claim 1, wherein each blank of the set is for forming a top engaging carrier applicable to articles of a sleek design.

11. A blank for forming a top engaging carrier, the blank comprising a plurality of apertures each for receiving a portion of a generally cylindrical article wherein a first distance ($D_1$) between the centres of two adjacent ones of the apertures is generally equal to the maximum diameter ($D_c$) of the article and a corner radius ($R_b$) of the blank is greater than a half of the maximum diameter ($D_c$) of the article.

12. The blank of claim 11 wherein the corner radius ($R_b$) is at least ⅛ inch (3.175 mm) greater than a half of the maximum diameter ($D_c$) of the article.

13. The blank of claim 11 wherein a fourth distance ($R_s$) is defined between the outer end of each tab-defining element and the centre of the respective aperture, the fourth distance ($R_s$) is equal to or less than a half of the maximum diameter ($D_c$) of a generally cylindrical article adapted to be engaged by that blank.

14. The blank of claim 11 wherein the maximum diameter ($D_a$) of each aperture is less than the upper end diameter ($D_n$) of the article.

15. The blank of claim 11 wherein any point on the outline of a finger aperture formed in the blank is disposed outside an area defined by a radius equal to half of the maximum diameter (½ Dc) around the centre of any one of the apertures which surround the finger aperture.

* * * * *